US005620011A

United States Patent [19]

Flowers

[11] Patent Number: 5,620,011

[45] Date of Patent: Apr. 15, 1997

[54] DIVER'S IMPROVED MOUTHPIECE APPARATUS

[76] Inventor: Damian T. Flowers, 9389 Halsell, Gulfport, Miss. 39503

[21] Appl. No.: 684,304

[22] Filed: Jul. 18, 1996

[51] Int. Cl.[6] ..... A61C 5/14

[52] U.S. Cl. ..... 128/859; 128/861

[58] Field of Search ..... 128/848, 859–862; 2/2, 9, 427, 436; 433/6, 37

[56] References Cited

U.S. PATENT DOCUMENTS

| | | | |
|---|---|---|---|
| 516,561 | 3/1894 | Bosch . | |
| 2,824,561 | 2/1958 | Mueller | 128/252 |
| 2,826,201 | 3/1958 | Yoder | 128/359 |
| 3,532,091 | 10/1970 | Lerman | 128/861 |
| 4,044,762 | 8/1977 | Jacobs | 128/136 |
| 4,064,628 | 12/1977 | Weitzman | 32/14 B |
| 4,815,893 | 3/1989 | Feder | 405/186 |
| 4,862,903 | 9/1989 | Campbell | 128/861 |
| 4,955,393 | 9/1990 | Adell | 128/861 |
| 5,082,007 | 1/1992 | Adell | 128/859 |
| 5,323,787 | 6/1994 | Pratt | 128/862 |
| 5,395,392 | 3/1995 | Suhonen | 606/234 |

*Primary Examiner*—Michael A. Brown
*Attorney, Agent, or Firm*—Pravel, Hewitt, Kimball & Krieger

[57] ABSTRACT

A diver's mouthpiece, having a conventional first portion, which includes a molded front flat member which is secured along the forward surface of the gums of the diver during use, and a teething member on each inner surface of the flat, molded member, so that a diver's teeth may bite into the teething member to help maintain the mouthpiece in place. There is further provided a pocket formed in each of the teething members, the pocket so shaped so as to accommodate a mint gel capsule in each of the pockets for the mouthpiece. There is further provided a pair of ducks extending between the pocket of the mouthpiece between the pocket containing the mint gel and the inner surface of the teething members, so as to define a flow track for the gel when the teeth of the diver bite into the teething members and rupture the outer casing of the mint gels in the teething members. Further, the pockets formed in each of the teething members to house the mint gel capsule are access to a slit in the upper surface of each of the teething members so that the mint gel may slide into the pockets yet are prevented from sliding out due to the fight slit formed in each of the upper surfaces of the teething members.

8 Claims, 1 Drawing Sheet

DIVER'S IMPROVED MOUTHPIECE APPARATUS

BACKGROUND OF THE INVENTION

1. Field of the Invention

The apparatus of the present invention relates to divers and their equipment. More particularly, the present invention relates to a mouthpiece of the type used by divers, which would accommodate a mint capsule therein for enhancing the flavor of the mouthpiece during a diving excursion.

2. General Background

In the sport and vocation of diving, divers, by necessity, are require to utilize a mouthpiece which is, in most cases, a rubberized member having a portion for fitting against the gums of the diver, and internal members which allow the diver to clamp his teeth onto the mouthpiece during the diving excursion. One of the problems or discomforts which are suffered by the diver in most cases, is the fact that after a prolonged use of the mouthpiece in the divers mouth, the mouthpiece tends to create a rather distasteful taste, and it becomes somewhat distracting and uncomfortable during the excursion. Furthermore, this unpleasant taste is usually as a result of the salt water when one is doing open water diving. In the past, the treatment for preventing this condition was to spray some mint fluid into one's mouth, or drinking something sweet just prior to diving. The problem with this remedy is that it didn't last the length of the dive, so therefore, before a diver could surface, there would be a horrendous taste in the diver's mouth, which could possible lead beyond the taste to nausea, indigestion and cotton mouth. Although this may not be a life threatening situation, because of the fact that divers must be very alert and focused during diving, due to hazards that may be life threatening, it is important that a diver be as comfortable as possible, particularly in the area of the mouth, so as to not have any reason to inadvertently allow water or the like to enter the air passageways during diving.

Therefore, there is a need in the art for a device which may help to enhance the flavor of a diver's mouthpiece, so that the uncomfortable mouthpiece can be avoided, and a diver may be able to concentrate more fully on his diving excursion.

In a search conducted of the art in this field, several patents were found in the search, and are incorporated herein in the prior art statement submitted herewith.

SUMMARY OF THE PRESENT INVENTION

The apparatus of the present invention solves the problems in a simple and straight forward manner. What is provided is a molded robber diver's mouthpiece, having an outer first portion, which includes a molded front fiat member which is secured along the forward surface of the gums of the diver during use, and a teething member on each inner surface of the flat, molded member, so that a diver's teeth may bite into the teething member to help maintain the mouthpiece in place. There is further provided a pocket formed in each of the teething members, the pocket so shaped so as to accommodate a mint gel capsule in each of the pockets for the mouthpiece. There is further provided a pair of arcuate ducts extending between the pocket of the mouthpiece between the pocket containing the mint gel and the inner surface of the teething members, so as to define a flow track for the gel when the teeth of the diver bite into the teething members and rupture the outer casing of the mint gels in the teething members. Further, the pockets formed in each of the teething members to house the mint gel capsule are accessed via a slit in the upper surface of each of the teething members so that through force, the mint gel capsule may slide into the pockets yet are prevented from sliding out due to the tight slit formed in each of the upper surfaces of the teething members.

Therefore, it is a principal object of the present invention to provide an improved diver's mouthpiece, where a diver may when biting into teething members on the mouthpiece, be provided with a source of mint gel to enhance the taste of the mouthpiece;

It is a further object of the present invention to provide a diver's mouthpiece, having the ability to accommodate a mint gel capsule in each of the teething members, so that when the teething members of the mouthpiece are bitten into, the mint capsule is ruptured, and gel flows into the diver's mouth.

It is a further object of the present invention to provide an improved diver's mouthpiece, which houses a mint gel capsule in each of the teething members of the mouthpiece, so that when a diver bites into the teething member, a mint capsule is ruptured, and the gel flows through arched passageways, which helps to regulate the amount of flow of gel into the diver's mouth, so that as to form a more continuous and long lasting flow of gel during use.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
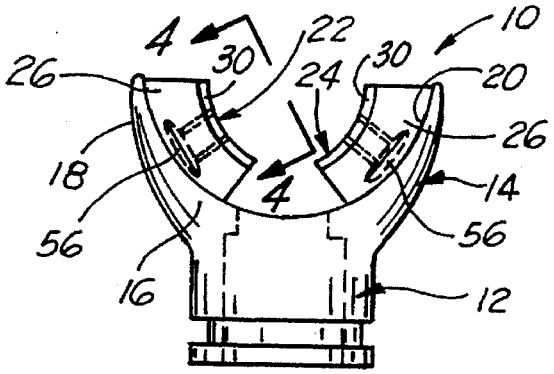
FIG. 1 is an overall view of the apparatus of the present invention.
Figure 2:
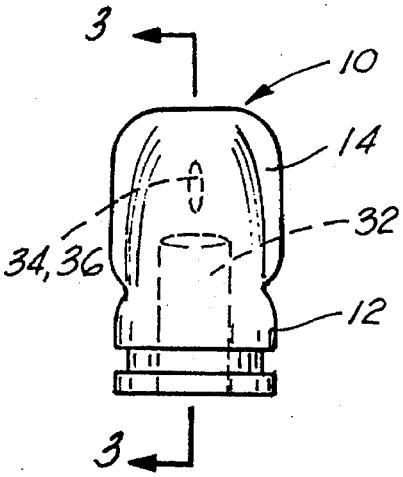
FIG. 2 is an overall side view of the apparatus of the present invention.

FIGS. 1–4 illustrated the preferred embodiment of the apparatus of the present invention through the numeral 10. As seen in overall view in FIG. 1, there is illustrated a diver's mouthpiece 10, which includes a forward portion 12, which would be secured to an airflow tube or the like, and remain substantially outside a diver's mouth. Further, there is a rear portion 14, which would be the portion of the mouthpiece 10 placed into a user's mouth. As seen in top view in FIG. 1, rear potion 14 of the mouthpiece 10 includes an arcuate flexible mouth portion 16, having an outer surface 18 and an inner surface 20. The arcuate portion 16 would define the portion of the mouthpiece 10 that is inserted into the user's mouth, and with the inner surface 20, being secured firmly against the upper and lower gums of the user, in this case, a diver.

Figure 4:
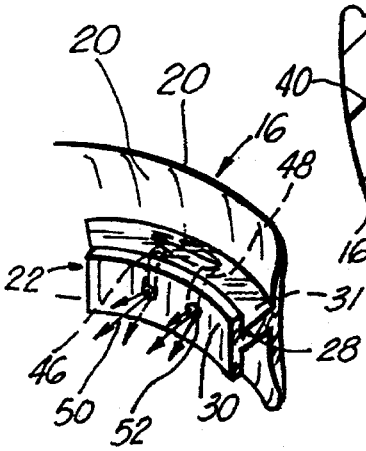
FIG. 4 is a partial view along lines 4—4 in FIG. 1 of the preferred embodiment of the apparatus of the present invention.

Further, as seen in FIG. 1 and in partial view in FIG. 4, the inner surface 20 of the arcuate portion 16 further includes a pair of teething portions 22, 24, each of the teething portions 22, 24 being integrally formed onto the inner surface 20 of fie arcuate portion 16, and including upper and lower biting surfaces 26, 28, and an inner vertical wall portion 30. Each of the upper and lower surfaces 26, 28, of each of the teething members 22, 24, in the preferred embodiment, would be defined by the space 31 between the inner surface 20 of the arcuate portion 16, and the vertical wall portion 30 to define a biting surface 35. That biting surface 35 would be of sufficient width to accommodate the width of the back teeth of the diver as the upper and lower back teeth would bite onto the upper and lower surfaces 26, 28, of each of the teething members during use. In a conventional mouthpiece, such biting onto the upper and lower surfaces 26, 28, would help to secure the mouthpiece 10 in place with the inner surface 20 of arcuate member 16 being secured firmly against the gums of the wearer.

Figure 3:
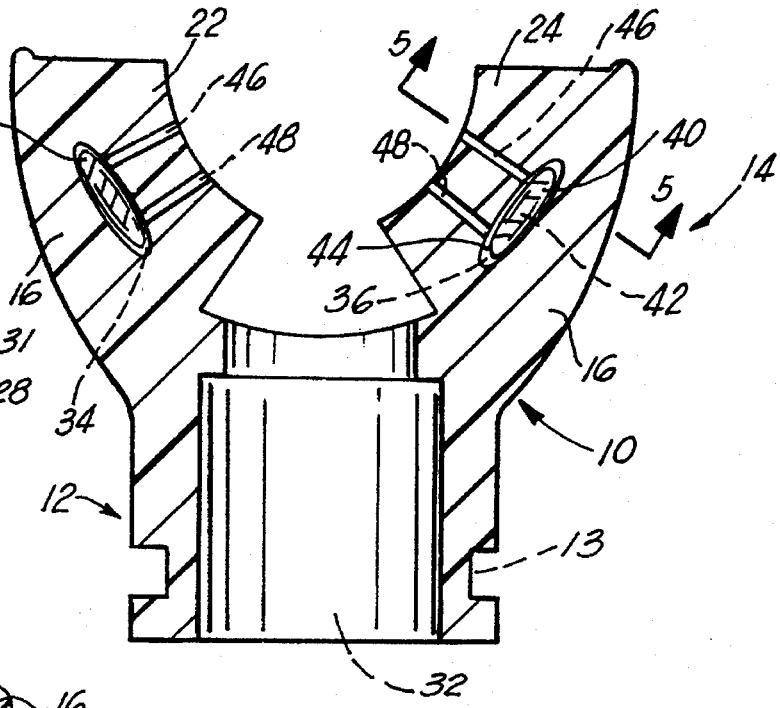
FIG. 3 is a top view along lines 3—3 of FIG. 2 of the preferred embodiment of the apparatus of the present invention.

As seen in FIG. 3, which is a cross section along the longitudinal plane of the mouthpiece, there is illustrated in top view the forward portion 12 of the mouthpiece 10, having the continuous channel 13 formed in its outer surface for connectedly engaging onto an air line or the like. Further, the forward portion 12 includes a continuous large bore 32, where airflow flows therethrough into the rear portion 14 of the mouthpiece 10. As seen further, the arcuate portion 16 is seen in top view, with the teething members 22 and 24 extending therefrom, for defining the portion 14 of the mouthpiece 10 into which a diver bites into. As seen further in FIG. 3, there is included a pair of pockets 34, 36, formed in each of the teething members 22, 24, the pair of pockets sized and shaped so as to accommodate a mint gel capsule 40, of the shape and size as seen in FIG. 4. The mint gel capsule 40 as seen in FIG. 4 is a typical mint gel capsule having a fluid gel 42 within and a thin skin 44, so that it easily bursts upon pressure being placed thereupon.

Figure 5:
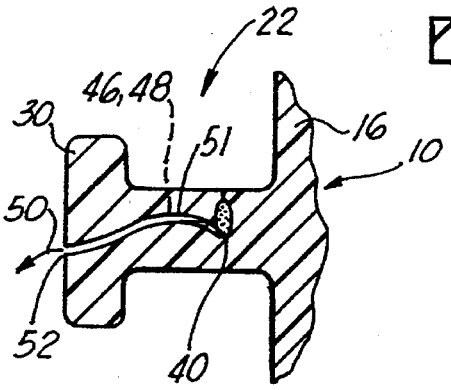
FIG. 5 is a cross sectional view along lines 5—5 in FIG. 3 of the arcuate channels in the preferred embodiment of the apparatus of the present invention.

As further seen in top view in FIG. 3, and in section view in FIG. 5, each of the pockets 34, 36 formed in the teething members 22, 24 of the mouthpiece 10, include the pair of arcuate channels 46, 48, extending between each pocket 34, 36 and the inner surface of the vertical wall 30 of each of the teething members 22, 24. These arcuate charmels 46, 48 would define a means for allowing gel 42 from each of the gel capsules 40 that have been ruptured, to flow from the pockets housing the gel capsules 40, through each of the arcuate channels 46, 48 in the direction of arrows 5D, and to enter into the mouth of the diver at exit points 52, as seen in FIG. 4. For purposes of structure, as seen particularly in FIG. 5, each of the channels 46, 48, are slightly arcuate or arched, forming a vertically inclined arch 49, in nature so as to regulate the flow of gel flowing from the mint capsule 40 contained in each pocket 34, 36 through the arched channels 46, 48, and into the mouth of the user. As seen in FIG. 5, because of the vertically inclined arch, in order for gel to travel between the gel capsule 40 and the exit point 52 of each of the arcuate channels 46, 48, the diver must bring force down on the gel capsule 40 with his teeth, so that the gel from the mint is forced to move upward within each of the channels 46, 48 so that it may flow over the arch 49, and flow through the remainder of channels 46, 48, and exit at exit point 52. By doing so, the diver is able to take advantage of the mint gel taste through an extended period of time over the course of the dive, rather than have the gel from the capsules flow into his mouth quite readily and the taste be experienced only for a short time.

As seen further in FIG. 1, it should be noted that each of the pockets 34, 36, formed in each of the teething members 22, 24 would have an upper opening or slit 56 in the rubberized material which makes up the mouthpiece. The slit 56 is a flexible slit and would allow one to slide a gel capsule 42 through the slit 56 and into each pocket 34, 36. Once in place, the slit 56 would then return back to its closed position, and therefore, would prevent the capsule 42 from sliding out of the pocket inadvertently. This is important due to the buoyancy of the mouthpiece during use, and the fact that the mint gel capsule is being held in place throughout the dive. In the preferred embodiment, the diver's mouthpiece 10, would require the diver's teeth pressure on the teething members 22, 24 to activate the exact time of the release of the mint gel 42 as needed. Should a diver decrease the teeth pressure, this would stop the release of the mint gel 42 flow through the mouthpiece 10. Therefore, in the preferred embodiment, the diver has total control over the release of the mint gel 42 and is not distracted while exploring the underworld. Again, it is important to understand that the diver's mouthpiece 10 with the small arched tubes or ducts 46, 48 on the inside of the teething area eliminates free flowing of the mint gel 42 or substance. Likewise, since the mint gel capsules 40 are made slightly larger than the slit or opening 56 in the upper face of each of the teething members 22, 24, but the mint gel capsules 40 fit perfectly into the pockets. These pockets are designed to maintain the mint gel capsules from moving or coming out of the mouthpiece and perhaps choking the diver. The following table lists the part numbers and part descriptions as used herein and in the drawings attached hereto.

PARTS LIST

| Description | Part No. |
|---|---|
| mouthpiece | 10 |
| forward portion | 12 |
| continuous channel | 13 |
| rear portion | 14 |
| circuate flexible mouth portion | 16 |
| outer surface | 18 |
| inner surface | 20 |
| teething portions | 22, 24 |
| biting surfaces | 26, 28 |
| inner vertical wall portion | 30 |
| space | 31 |
| continuous large bore | 32 |
| biting surface | 35 |
| pockets | 34, 36 |
| mint gel capsule | 40 |
| fluid gel | 42 |
| thin skin | 44 |
| circuate channels | 46, 48 |
| arch | 49 |
| arrows | 50 |
| exit points | 52 |
| slit | 56 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An improved diver's mouthpiece comprising:

a) a mouthpiece potion, having a forward portion for connecting to an air tube, and the rear portion for fitting into a diver's mouth;

b) a pair of teething members formed on the inner wail of the rear portion, the teething members positioned between the upper and lower teeth of a diver for securing the mouthpiece in place;

c) a pocket formed in each of the teething members, the pocket sized and shaped to receive a mint gel capsule therein; and d) at least one duct extending from the pocket of each of the teething members to an inner surface of the teething members, so as to define a means for allowing gel to flow from the pocket containing the gel capsule to the mouth of the diver when sufficient force is placed on the capsule by the diver.

2. The apparatus in claim 1, further comprising an opening formed in each of the pockets, so that the gel capsule may be slid within the pocket, yet maintained in place prior to the diver placing force on each of the teething members so that the gel capsule may be ruptured and the gel flow therefrom.

3. The apparatus in claim 1, wherein the ducts extending from the pocket to the inner surface of the teething members form a vertical arch, so that the flow of gel to the diver is imparted through a force downward on the mint gel capsule in order to regulate flow through the ducts into the mouth of the diver.

4. The apparatus in claim 1, wherein there is further provided at least two ducts from each pocket of each teething member.

5. An improved diver's mouthpiece comprising:

a) a mouthpiece potion, having a forward portion for connecting to an air tube, and the rear portion for fitting into a diver's mouth;

b) a pair of teething members formed on the inner wall of the rear portion, the teething members positioned between the upper and lower teeth of a diver for securing the mouthpiece in place;

c) a pocket formed in each of the teething members, the pocket sized and shaped to receive a mint gel capsule therein; and d) at least one duct extending from the pocket of each of the teething members to an inner surface of the teething members, so as to define a means for allowing gel to flow from the pocket containing the gel capsule to the mouth of the diver when sufficient force is placed on the capsule by the diver; and e) an opening formed in each of the pockets, so that the gel capsule may be slid within the pocket, yet maintained in place prior to the diver placing force on each of the teething members so that the gel capsule may be ruptured and the gel flow therefrom.

6. The apparatus in claim 5, wherein at least two ducts extend from each pocket to the inner surface of the teething members, said ducts being vertically arched, so that the flow of the gel to the diver is imparted through force from the divers teeth against each of the mint gel capsules.

7. An improved diver's mouthpiece comprising:

a) a mouthpiece portion, having a forward portion for connecting to an air tube, and the rear portion for fitting into a diver's mouth;

b) a pair of teetering members formed on the inner wall of the rear portion, the teething members positioned between the upper and lower teeth of a diver for securing the mouthpiece in place;

c) a pocket formed in each of the teething members, the pocket sized and shaped to receive a mint gel capsule therein; and d) at least two ducts extending from the pocket of each of the teething members to an inner surface of the teething members, so as to define a means for allowing gel to flow from the pocket containing the gel capsule to the mouth of the diver when sufficient force is placed on the capsule by the diver; and e) an opening formed in each of the pockets, so that the gel capsule may be slid within the pocket, yet maintained in place prior to the diver placing force on each of the teething members so that the gel capsule may be ruptured and the gel flow therefrom.

8. The apparatus in claim 7, wherein said ducts form a vertical arch pathway between each of the pockets in the inner surface of each of the teething members so that the flow of gel to the diver may only occur through the force of the diver's teeth against the gel capsule in order to force the gel through the vertically arched ducts to the exit point into the diver's mouth.

* * * * *